US005931164A

United States Patent [19]

Kiely et al.

[11] Patent Number: 5,931,164

[45] Date of Patent: Aug. 3, 1999

[54] ATHLETIC MOUTHGUARD

[76] Inventors: Timothy Kiely; Sharlene Kiely, both of 33 Walcott St., Hopkinton, Mass. 01748

[21] Appl. No.: 09/136,598

[22] Filed: Aug. 19, 1998

[51] Int. Cl.[6] ..... A61C 5/14

[52] U.S. Cl. ..... 128/859; 128/861

[58] Field of Search ..... 128/848, 859–862; 2/2

[56] References Cited

U.S. PATENT DOCUMENTS

| | | | |
|---|---|---|---|
| 5,092,346 | 3/1992 | Hays | 128/859 |
| 5,462,066 | 10/1995 | Snyder | 128/861 |
| 5,511,562 | 4/1996 | Hancock | 128/859 |
| 5,692,523 | 12/1997 | Croll | 128/859 |

*Primary Examiner*—Michael A. Brown
*Attorney, Agent, or Firm*—John E. Toupal; Harold G. Jarcho

[57] ABSTRACT

A mouthguard including a U-shaped base portion; an upwardly projecting inner flange portion joined to an inner edge of the base portion; an upwardly projecting outer flange portion joined to an outer edge of the base portion; the upwardly projecting inner flange portion, the upwardly projecting outer flange portion and an upper surface of the base portion forming an upwardly facing U-shaped channel; and the mouthguard being molded from a composition including a light pervious foundation material, and a light reflective aggregate distributed throughout the foundation material.

20 Claims, 2 Drawing Sheets

ATHLETIC MOUTHGUARD

BACKGROUND OF THE INVENTION

This invention relates generally to a physical protection device and, more particularly, to a mouthguard for use in protecting against physical injury.

Mouthguards are used extensively to prevent bodily injury to participants in athletic activities such as hockey, soccer, field hockey, lacross, and the like. Such mouthguards are available and have been proposed in a wide variety of forms and shapes and with various structural features directed at increased effectiveness and reduced cost. However, prior mouthguards have failed to fully overcome a reluctance by many athletic participants to utilize mouthguards for a variety of reasons including general unattractiveness. Desired increased use of mouthguards can be effected, therefore, by enhancing the aesthetic characteristics of mouthguards.

The object of this invention, therefore, is to provide a mouthguard with an aesthetically improved appearance for stimulating more extensive use.

SUMMARY OF THE INVENTION

The invention is a mouthguard including a U-shaped base portion; an upwardly projecting inner flange portion joined to an inner edge of the base portion; an upwardly projecting outer flange portion joined to an outer edge of the base portion; the upwardly projecting inner flange portion, the upwardly projecting outer flange portion and an upper surface of the base portion forming an upwardly facing U-shaped channel; and the mouthguard being molded from a composition including a light pervious foundation material, and a light reflective aggregate distributed throughout the foundation material. The light reflective aggregate enhances the aesthetic characteristics of the mouthguard to thereby encourage its use.

According to one feature of the invention, the foundation material is a thermoplastic and the aggregate is a polyester material. These materials are especially suitable for the desired objectives of the invention.

According to another feature of the invention, the foundation material can be heated to a malleable state to facilitate fitting of the mouthguard to a particular user by the creation of teeth indentations.

According to yet another feature of the invention, the mouthguard further includes a downwardly projecting inner flange portion joined to the inner edge of the base portion, and a downwardly projecting inner flange portion joined to the outer edge of the base portion; the downwardly projecting inner flange portion, the downwardly projecting outer flange portion and a lower surface of the base portion forming a downwardly facing U-shaped channel. The downwardly facing channel accommodates a user's lower teeth.

The invention also encompasses a method of making a mouthguard including the steps of providing a first volume of a light pervious particulate material; providing a second volume of light reflective aggregate; mixing the first volume with the second volume to provide a composite mixture; and forming the composite mixture into a mouthguard. The method enhances protective use by providing an attractive mouthguard.

According to one feature of the method, the particulate material is a thermoplastic material and the forming step includes the steps of heating the composite mixture; forming an injection mold of the mouthguard; and injection molding the mouthguard in the injection mold. This feature provides a desired mouthguard in a highly efficient manner.

According to a further feature of the method, the first volume is substantially larger than the second volume and preferably at least 100 times larger than the second volume. This volume ratio provides an ideal composition.

BRIEF DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENTS

Figure 1:
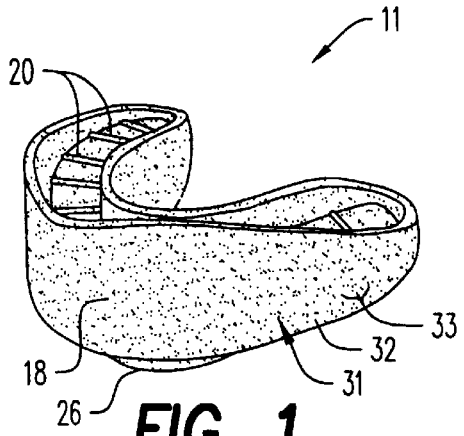
FIG. 1 is a front right perspective view of the mouthguard invention.

A mouthguard 11 is shaped and dimensioned for retention in the mouth of a user engaged in an athletic endeavor. Included in the mouthguard 11 is a base portion 12 and upper and lower portions 13, 14 projecting therefrom. The upper and lower portions 13, 14 are shaped and arranged to receive, respectively, the upper and lower teeth of a user as described hereinafter.

Forming the upper portion 13 are an upwardly projecting inner flange portion 16 joined to an inner edge 17 of the base portion 12 and an upwardly projecting outer flange portion 18 joined to an outer edge 19 of the base portion 12. The upwardly projecting inner and outer flange portions 16, 18 extend transversely from an upper surface 21 of the base portion 12. Together, the upper surface 21 and upwardly projecting inner and outer flange portions 16, 18 form an upwardly facing U-shaped channel 23 shaped and arranged to receive the upper teeth of a user. A plurality of longitudinally spaced apart, transversely extending ribs 20 are formed along the upper surface 21 of the base portion 12.

The lower portion 14 of the mouthguard 11 includes a downwardly projecting inner flange portion 26 joined to the inner edge 17 of the base portion 12 and a downwardly projecting outer flange portion 25 joined to the outer edge 19 of the base portion 12. As shown, the downwardly projecting inner and outer flange portions 26, 25 extend transversely from, respectively, the inner and outer edges 17, 19 of the base portion 12. Together with a lower surface 28 of the base portion 12 the downwardly projecting inner and outer flange portions 26, 25 form a downwardly facing U-shaped channel 29 shaped and arranged to receive the lower teeth of a user. A plurality of longitudinally spaced apart, transversely extending ribs 30 are formed along the lower surface 28 of the base portion 12.

The mouthguard 11 is used in the conventional manner to reduce the risk of physical injury to a user engaged in an athletic activity. During such use, the mouthguard 11 is positioned in the user's mouth with upper and lower teeth (not shown), received, respectively, by the upwardly and downwardly facing U-shaped channels 23, 29. However, to encourage its protective use, the mouthguard 11 is molded from a composition 31 comprising a transparent or translucent, light pervious foundation material 32 and a light reflective aggregate 33 distributed throughout and visible within the foundation material 32. The composition 31 provides an attractive appearance which inspires use of the mouthguard 11 and thereby reduces the occurrence of various types of head and mouth injuries. Further interest in use can be stimulated by employing a light reflective aggregate 33 having a color corresponding to the color of a team with which a user is participating.

Figure 2:
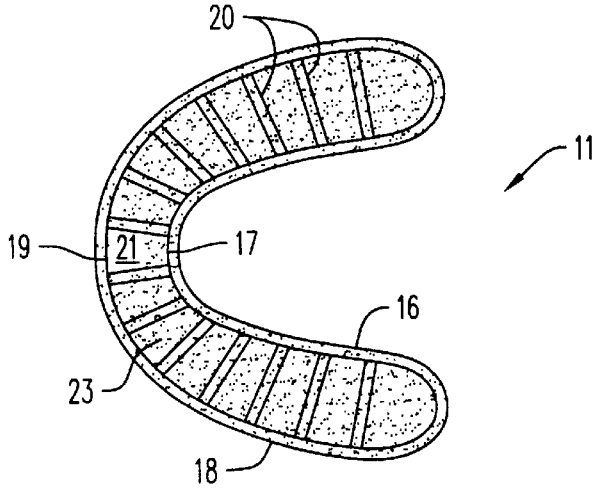
FIG. 2 is a top plan view of the mouthguard shown in FIG. 1.
Figure 3:
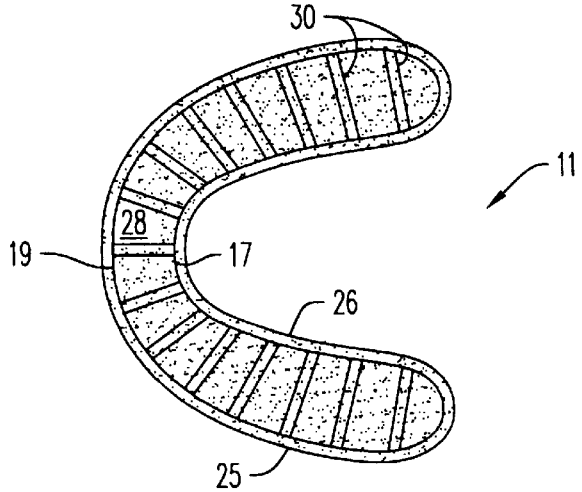
FIG. 3 is a bottom plan view of the mouthguard shown in FIG. 1.
Figure 4:
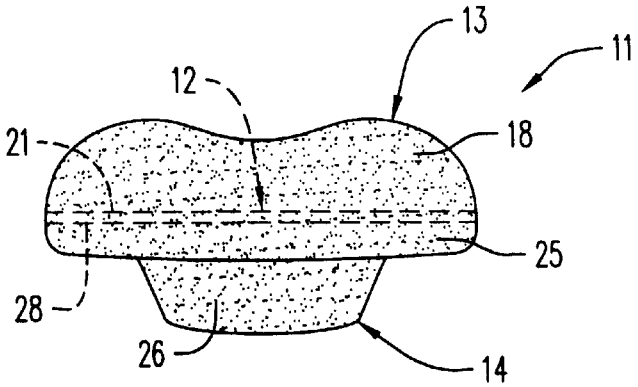
FIG. 4 is a front elevational view of the mouthguard shown in FIG. 1.
Figure 5:
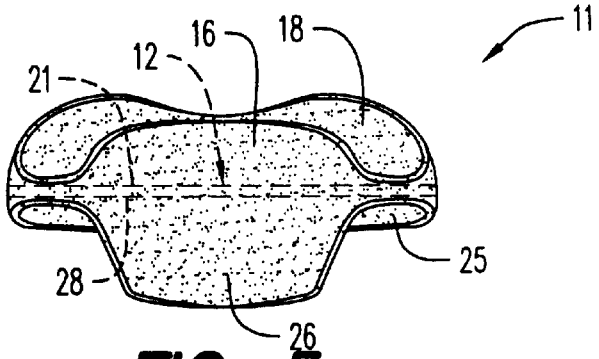
FIG. 5 is a rear elevational view of the mouthguard shown in FIG. 1.
Figure 6:
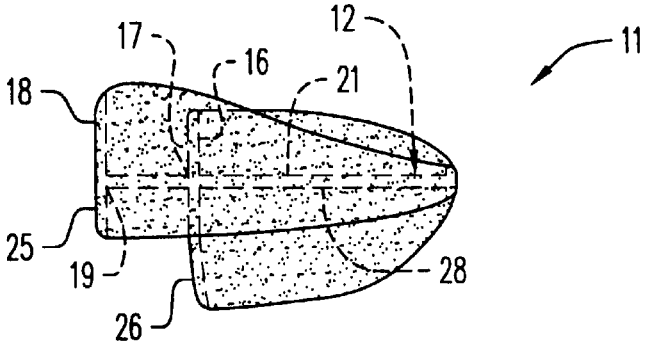
FIG. 6 is a right side elevational view of the mouthguard shown in FIG. 1.

The mouthguard 11 is made by first combining a first volume of a suitable particulate light pervious material and a second volume of a light reflective aggregate. The resultant composite mixture then is molded to form the mouthguard 11 in the general form and shape shown in FIGS. 1–6. Preferably, the mouthguard 11 is formed in an injection mold with a conventional injection molding process employing a transparent or translucent thermoplastic material for the foundation material 32. Also, the thermoplastic material preferably is a type which can be heated to a malleable state to facilitate fitting of the mouthguard to a particular user by the creation of teeth indentations.

In a specific example, a first volume of Dupont Elvax EVA 240 pellets are blended with a non-toxic polyester glitter aggregate to provide a composite mixture. The first thermoplastic pellet volume is approximately 200 times larger then the second polyester aggregate volume. After blending, the composite mixture is loaded into a feed hopper of an injection molding machine in which it is melted at 260° F. in the machine's barrel. The heated mixture then is pushed under high pressure into a chilled aluminum mold having a cavity shape of the mouthguard 11. After a brief cooling cycle, the mold is opened and the finished mouthguard 11 is removed.

Obviously, many modifications and variations of the present invention are possible in light of the above teachings. For example, the mouthguard 11 can be provided with a conventional strap for attachment to a user's helmet or the like. It is to be understood, therefore, that the invention can be practiced otherwise than as specifically described.

What is claimed is:

1. A mouthguard comprising a U-shaped base portion; an upwardly projecting inner flange portion joined to an inner edge of said base portion; an upwardly projecting outer flange portion joined to an outer edge of said base portion; said upwardly projecting inner flange portion, said upwardly projecting outer flange portion and an upper surface of said base portion forming an upwardly facing U-shaped channel; and wherein said mouthguard is molded from a composition comprising a light pervious foundation material, and a light reflective aggregate distributed throughout and visible within said foundation material.

2. A mouthguard according to claim 1 wherein said foundation material is a thermoplastic.

3. A mouthguard according to claim 2 wherein said aggregate is a polyester material.

4. A mouthguard according to claim 1 wherein said foundation material can be heated to a malleable state to facilitate fitting of said mouthguard to a particular user by the creation of teeth indentations.

5. A mouthguard according to claim 4 wherein said foundation material is a thermoplastic.

6. A mouthguard according to claim 5 wherein said aggregate is a polyester material.

7. A mouthguard according to claim 1 wherein said mouthguard further comprises a downwardly projecting inner flange portion joined to said inner edge of said base portion, and a downwardly projecting outer flange portion joined to said outer edge of said base portion; said downwardly projecting inner flange portion, said downwardly projecting outer flange portion and a lower surface of said base portion forming a downwardly facing U-shaped channel.

8. A mouthguard according to claim 7 wherein said foundation material is a thermoplastic.

9. A mouthguard according to claim 8 wherein said aggregate is a polyester material.

10. A mouthguard according to claim 7 wherein said foundation material can be heated to a malleable state to facilitate fitting of said mouthguard to a particular user by the creation of teeth indentations.

11. A mouthguard according to claim 10 wherein said foundation material is a thermoplastic.

12. A mouthguard according to claim 11 wherein said aggregate is a polyester material.

13. A method of making a mouthguard comprising the steps of:

providing a first volume of light pervious particulate material;

providing a second volume of light reflective aggregate;

mixing said first volume with said second volume to provide a composite mixture; and forming said composite mixture into a mouthguard.

14. A method according to claim 13 wherein said particulate material is a thermoplastic material and said forming step comprises the steps of:

heating said composite mixture;

forming an injection mold of said mouthguard; and injection molding said mouthguard in said injection mold.

15. A method according to claim 14 wherein said first volume is substantially larger than said second volume.

16. A method according to claim 15 wherein said first volume is at least 100 times larger than said second volume.

17. A method according to claim 13 wherein said mouthguard comprises a U-shaped base portion; an upwardly projecting inner flange portion joined to an inner edge of said base portion; an upwardly projecting outer flange portion joined to an outer edge of said base portion; a downwardly projecting inner flange portion joined to said inner edge of said base portion; and a downwardly projecting outer flange portion joined to said outer edge of said base portion.

18. A method according to claim 17 wherein said particulate material is a thermoplastic material and said forming step comprises the steps of:

heating said composite mixture;

forming an injection mold of said mouthguard; and injection molding said mouthguard in said injection mold.

19. A method according to claim 18 wherein said first volume is substantially larger than said second volume.

20. A method according to claim 19 wherein said first volume is at least 100 times larger than said second volume.

* * * * *